US007921788B2

(12) United States Patent
Fujihara

(10) Patent No.: US 7,921,788 B2
(45) Date of Patent: Apr. 12, 2011

(54) SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 993 days.

(21) Appl. No.: 11/802,512

(22) Filed: May 23, 2007

(65) Prior Publication Data

US 2007/0272135 A1 Nov. 29, 2007

(30) Foreign Application Priority Data

May 24, 2006 (JP) ..... 2006-143856

(51) Int. Cl.
*D05B 29/02* (2006.01)
*D05B 29/00* (2006.01)

(52) U.S. Cl. ..... 112/237

(58) Field of Classification Search ..... 112/235–240
See application file for complete search history.

(56) References Cited

U.S. PATENT DOCUMENTS

| | | | | | |
|---|---|---|---|---|---|
| 2,008,621 | A * | 7/1935 | Mattingly | 112/238 |
| 4,388,886 | A * | 6/1983 | Adams | 112/237 |
| 4,409,914 | A * | 10/1983 | Sansone | 112/237 |
| 4,706,587 | A * | 11/1987 | Shiomi | 112/237 |
| 5,461,997 | A * | 10/1995 | Landen | 112/237 |
| 2002/0020333 | A1 * | 2/2002 | Yoshikazu | 112/237 |

FOREIGN PATENT DOCUMENTS

| | | |
|---|---|---|
| JP | A 8-332290 | 12/1996 |
| JP | A 2006-20757 | 1/2006 |

* cited by examiner

*Primary Examiner* — Ismael Izaguirre
(74) *Attorney, Agent, or Firm* — Oliff & Berridge, PLC

(57) ABSTRACT

A sewing machine comprising: vertical movement actuator that vertically moves the presser bar having a presser foot; a control unit, that controls the vertical movement actuator to selectively execute a first mode or a second mode; a mode switch unit capable of selectively switching between the first mode and the second mode; and the control unit, when switched to the first mode, controls the vertical movement actuator so as to retain the presser foot at a cloth pressing position irrespective of an operational status of a sewing process; and when switched to the second mode, controls the vertical movement actuator so as to retain the presser foot in a slightly lifted position while a sewing operation is ongoing, whereas when the sewing operation is stopped, the presser foot is moved and retained in the cloth pressing position.

8 Claims, 8 Drawing Sheets

SEWING MACHINE

This application is based upon and claims the benefit of priority from the prior Japanese Patent Application 2006-143856, filed on, May 24, 2006 the entire contents of which are incorporated herein by reference.

FIELD

The present disclosure is directed to a sewing machine capable of vertically driving a presser bar having a presser foot mounted thereto by a vertical movement actuator. The present disclosure is directed more particularly to a sewing machine that prevents displacement of workpiece cloth when executing a sewing operation with the presser foot elevated by a predetermined small distance, for instance, while sewing is stopped during free motion quilting.

BACKGROUND

Sewing machines capable of free motion quilting in addition to utility sewing have been provided conventionally. In utility sewing, the sewing machine executes a sewing operation while feeding a workpiece cloth by longitudinally moving a feed dog provided on a bed. In free motion quilting, the sewing machine lifts the presser bar having a presser foot mounted thereto and maintains the lifted state where the presser foot is spaced from the workpiece cloth by a predetermined small distance. Thus, the user is allowed to manually move the workpiece cloth placed on the upper surface of the bed freely.

A sewing machine capable of embroidery sewing disclosed in JP 2006-20757 A (patent document 1) is provided with a vertical movement mechanism that vertically moves the presser bar having a presser foot mounted thereto by a presser-bar driving step motor. The vertical movement mechanism is controlled by a control unit so as to maintain a predetermined small distance between the presser foot and the workpiece cloth during an embroidery sewing operation.

However, the sewing machine capable of embroidery sewing described in patent document 1 maintains the predetermined small spacing of the presser foot from the workpiece cloth not only during an embroidery sewing operation but also while the sewing operation is stopped. Thus, when the sewing operation is tentatively stopped during execution of free motion quilting, unintended user contact with the workpiece cloth causes displacement of the workpiece cloth. Also, a displacement of workpiece cloth may occur by the weight of the workpiece cloth itself when sewing a large workpiece cloth. The displacement of workpiece cloth causes displacement in sewing position when restarting the sewing operation, that is, the displacement in the position where the stitches are sewn.

In order to prevent sewing position displacement of the workpiece cloth when restarting the sewing operation, the sewing needle may be moved downward to a needle lowered position and anchor the sewing needle through the workpiece cloth when the sewing operation is tentatively stopped. However, in case of sewing large workpiece cloth, since the ends of the workpiece are pulled downward by its own weight, the sewing needle penetrating the workpiece cloth may be bent or a needle drop hole of the workpiece cloth may be pulled open and damage the workpiece cloth.

Also, when tentatively stopping the sewing operation, the presser foot may be lowered by manual operation of the presser foot lifting lever so that the workpiece cloth may be pressed by the lowered presser foot. However, manually lowering the presser foot upon every instance of stopping the sewing operation is cumbersome for the user and reduces work efficiency.

Further, in case of employing a generally used quilt presser that press the workpiece cloth intermittently; the workpiece cloth cannot be pressed by the presser foot when the sewing needle is placed in a needle raised position. Thus, as described earlier, the workpiece cloth may be displaced when the sewing operation is tentatively stopped in which case the position of the stitches sewn on the workpiece cloth when restarting the sewing operation is displaced.

SUMMARY

An object of the present disclosure is to provide a sewing machine capable of preventing displacement of the sewing position of the workpiece cloth when restarting the sewing operation when the sewing operation is being executed under the state in which the presser foot is elevated by a predetermined small distance, without reducing work efficiency.

A sewing machine of the present disclosure includes, a vertical movement actuator that vertically drives a presser bar having a presser foot attached thereto; a control unit that controls the vertical movement actuator to selectively execute a first mode or a second mode; a mode switch unit capable of selectively switching between the first mode and the second mode; and the control unit, when switched to the first mode, controls the vertical movement actuator so as to lower the presser foot and retain the presser foot at a cloth pressing position in which a workpiece cloth is pressed irrespective of an operational status of a sewing process; and when switched to the second mode, controls the vertical movement actuator so as to retain the presser foot in a slightly lifted position that is lifted from the workpiece cloth by a predetermined small distance while a sewing operation is ongoing, whereas when the sewing operation is stopped, the presser foot is moved and retained in the cloth pressing position.

According to the above configuration, when switched to the first mode, the presser foot is retained in the cloth pressing position irrespective of the operational status of the sewing process. Thus, normal sewing such as utility pattern sewing can be executed.

On the other hand, when switched to the second mode, the presser foot is retained in the slightly lifted position in which the presser foot is elevated from the workpiece cloth by a predetermined small distance while a sewing operation is ongoing. Thus, the user is allowed to manually feed the workpiece cloth and hence, being suitable for a sewing operation executed with the presser foot elevated by a predetermined small distance (quilt sewing in free motion, for example). In the second mode, since the presser foot is moved to the cloth pressing position when the sewing operation is stopped, the workpiece cloth is not displaced even if the user contacts the workpiece cloth while the sewing operation is stopped or when the workpiece cloth is affected by its own weight. Thus, displacement of sewing start position at the time of restarting the sewing operation can be prevented.

Further, since the presser foot is automatically moved to the cloth pressing position when the sewing operation is stopped, the user need not manually lower the presser foot upon every instance of stopping the sewing operation, thereby preventing the reduction of work efficiency.

A pattern selection unit that selects a sewing pattern or a sewing pattern group may be arranged to function as a mode switch unit, and the first mode may be set as a utility sewing mode that sews utility patterns and the second mode may be set as a free motion quilting mode that executes quilting in free motion.

Such construction allows automatic switching between the utility sewing mode identified as the first mode and the free motion quilting mode identified as the second mode by selecting the desired sewing pattern or sewing pattern group in a simple user operation.

When switched to the second mode, in restarting the sewing operation from the sewing operation stopped state, the presser foot may be arranged to move the presser foot from the cloth pressing position to the slightly lifted position.

Such configuration does not require the user to manually lift the presser foot when the sewing operation is restarted from the sewing operation stopped state in the second mode, thereby improving the work efficiency.

The presser foot may be arranged to be moved based on an input signal delivered from an operation input unit for starting and stopping the sewing operation.

Such configuration allows the presser foot to be readily moved by operating the operation input unit when the switch is made to the second mode.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One embodiment of the present disclosure will be described hereinafter with reference to the drawings.

Figure 1:
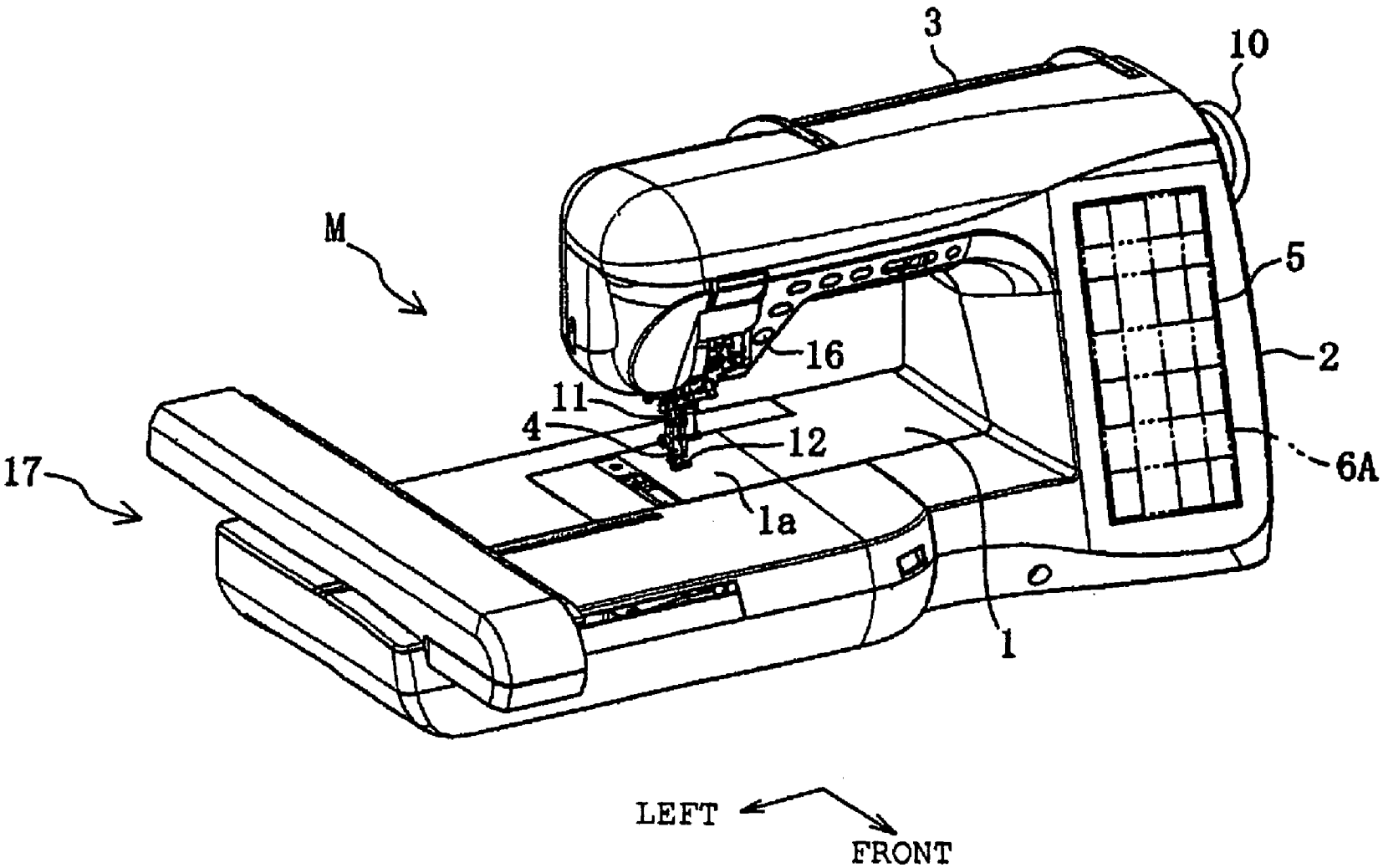
FIG. 1 is a perspective view of a sewing machine in accordance with one illustrative aspect of the present disclosure.
Figure 2:
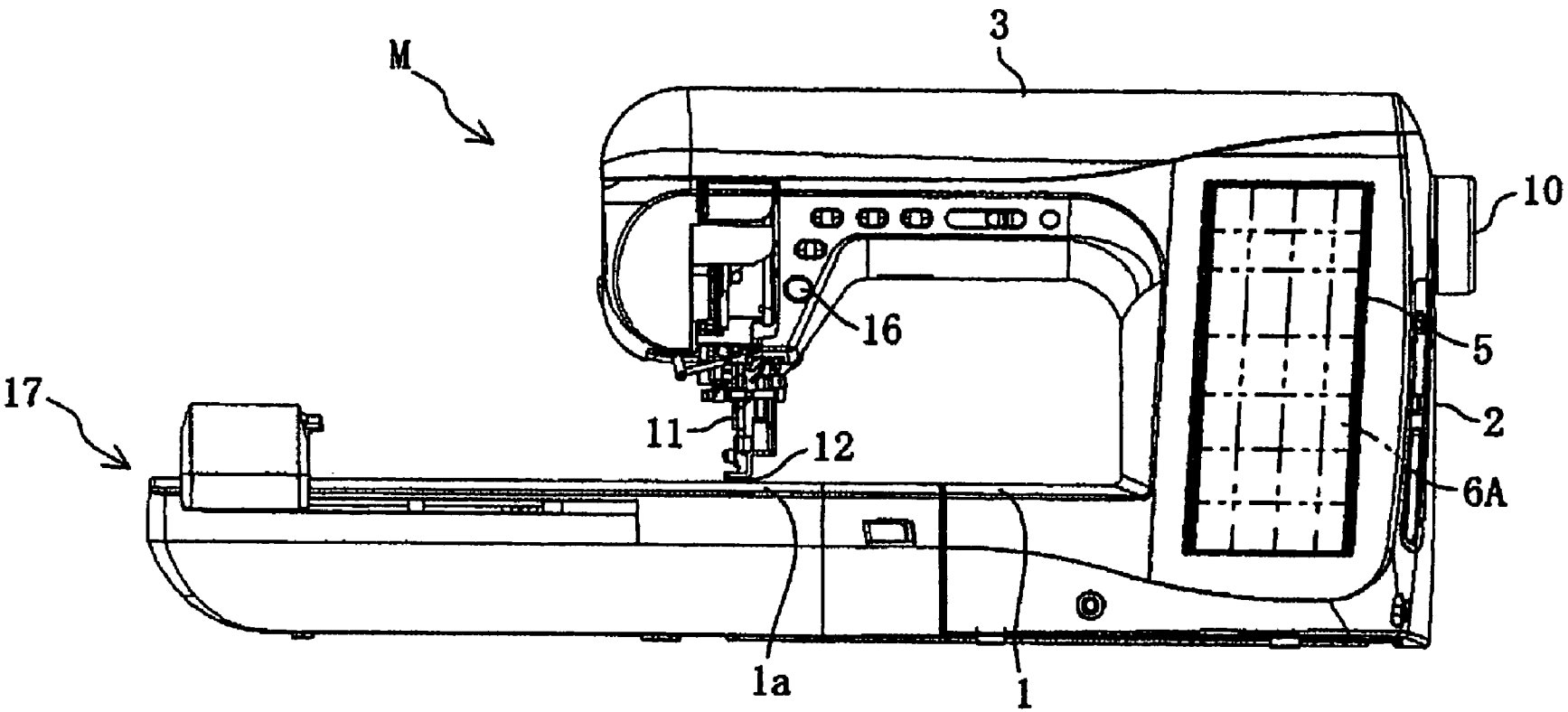
FIG. 2 is a front view of the sewing machine.

Referring to FIGS. 1 and 2, the sewing machine M includes a bed 1, a pillar 2 standing on the right end of the bed 1; and an arm 3 extending leftward in a protruding manner from the upper end of the pillar 2 so as to confront the bed 1. Provided below a needle plate 1*a* of the bed 1 are a feed dog vertically moving mechanism that vertically moves a feed dog; feed dog longitudinally moving mechanism that longitudinally moves the feed dog; a rotary shuttle mechanism detachably attached to a bobbin; and an automatic thread cut mechanism that cuts at least a needle thread, none of which are shown.

An embroidery frame drive mechanism 17 for executing embroidery sewing operation by using an embroidery frame is detachably attached to a free arm portion (peripheral portion of the needle plate 1*a*) of the bed 1. The embroidery frame drive mechanism 17 drives the embroidery frame (not shown) respectively in an X-direction (lateral direction) and a Y-direction (longitudinal direction) independently. When quilting in free motion, the embroidery frame drive mechanism 17 is detached from the free arm portion.

A feed dog vertically moving lever (not shown) is provided on a side wall of a portion exposed when the embroidery frame drive mechanism 17 is removed from the bed 1. When the feed dog vertically moving lever is manually operated, the feed dog is switched between an operating position and a non-operating position. In the operating position, the feed dog feeds the workpiece cloth by projecting above the upper surface of the bed 1. In the non-operating position the feed dog does not project above the upper surface of the bed 1 and does not feed the workpiece cloth.

The sewing machine M is provided with a touch panel 6A and by operating the touch panel 6A, selective switching is allowed between a first mode indicative of a utility sewing mode and a second mode indicative of a free motion quilting mode. Utility patterns are sewn in the first mode and quilting is executed in free motion in the second mode. In case of sewing utility patterns, the feed dog is switched to an operating position by manual operation of the feed dog vertically moving lever, whereas in case of quilting in free motion, the feed dog is switched to a non operating position by manual operation of the feed dog vertically moving lever.

Figure 5:
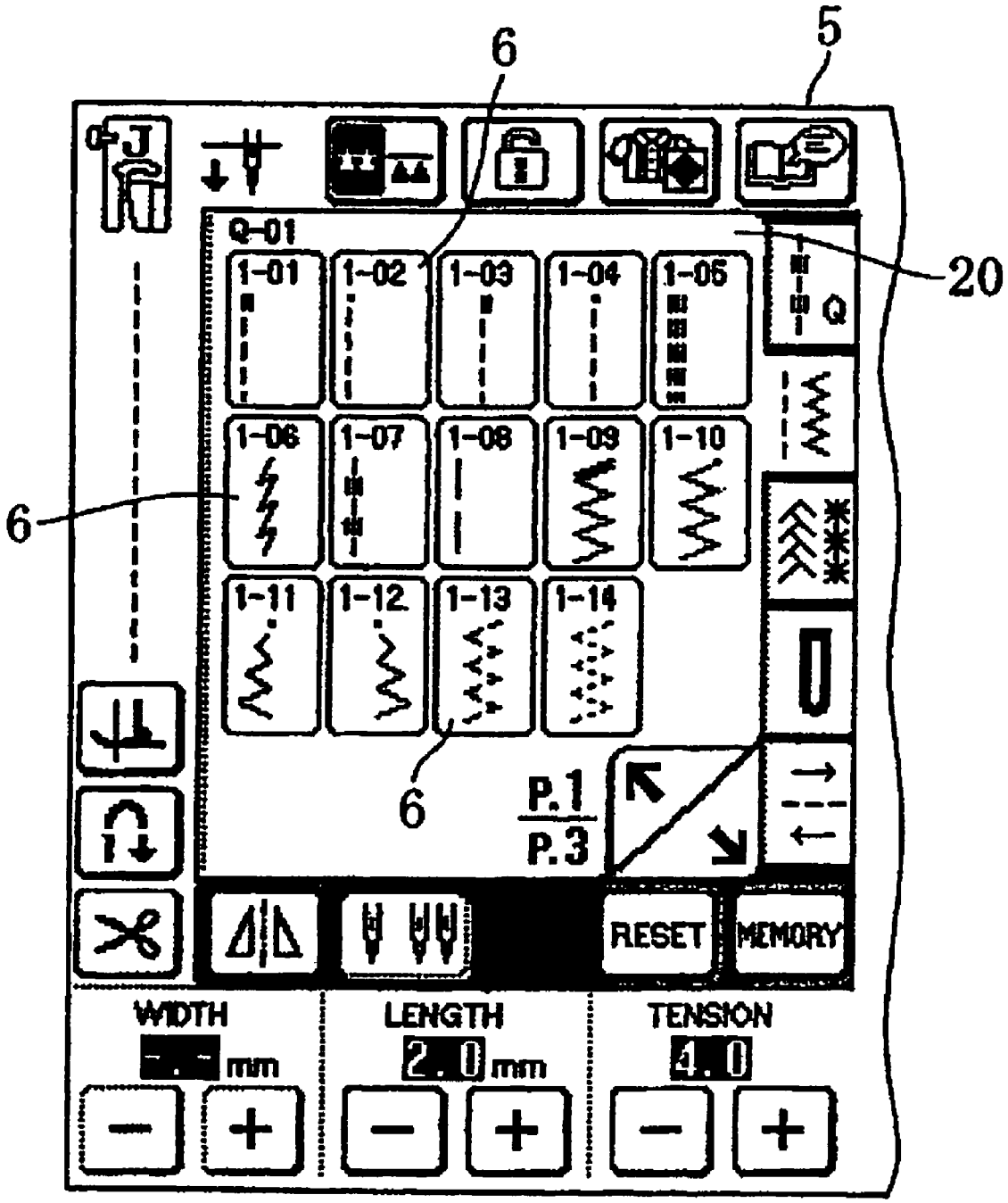
FIG. 5 is a sample display of a utility pattern selection screen.
Figure 6:
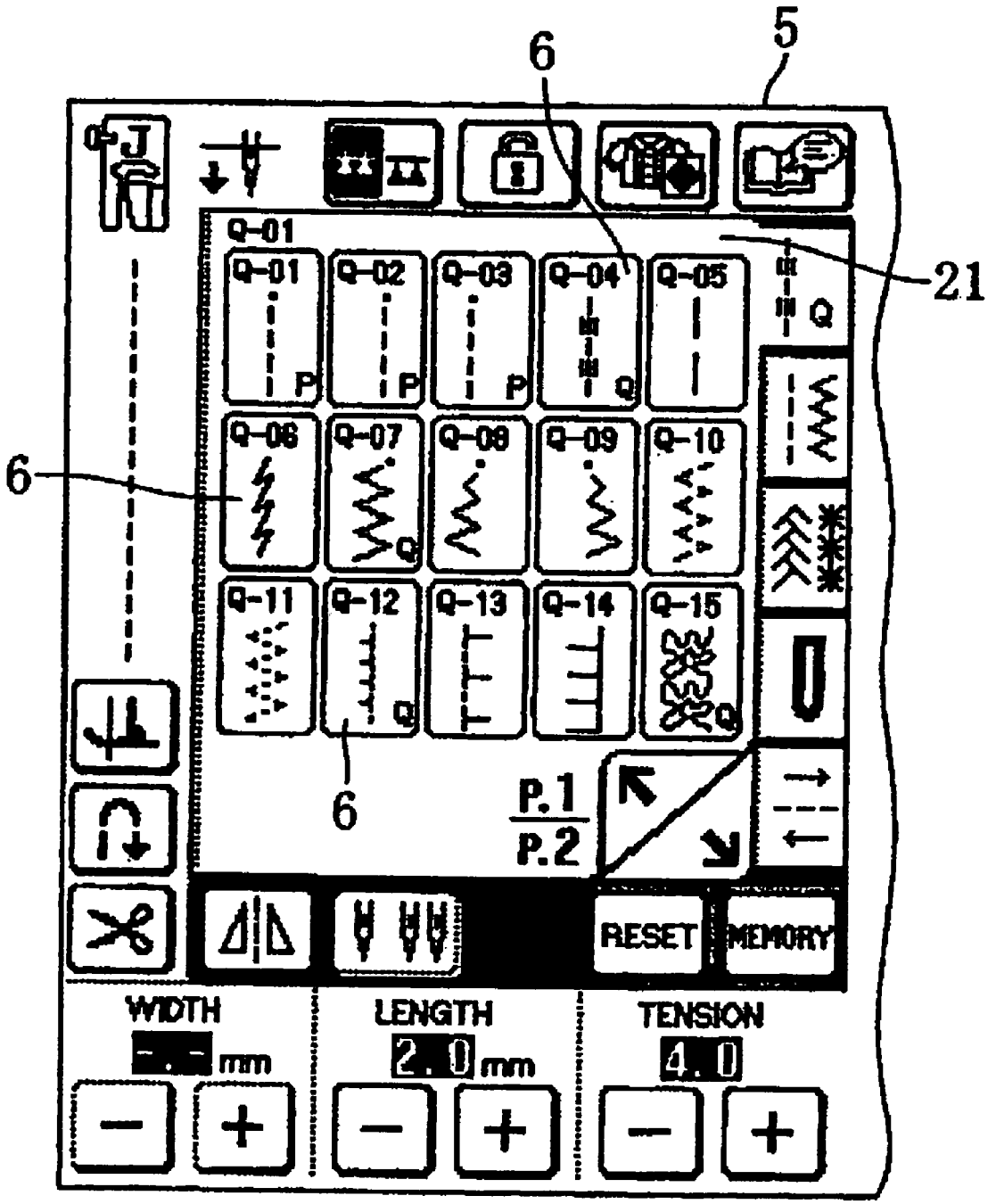
FIG. 6 is a sample display of a quilt pattern selection screen.

Provided in the front face of the pillar 2 is a large type liquid crystal display 5 (hereinafter referred to as color display 5) capable of displaying color images. The color display 5 displays a menu screen, a utility pattern selection screen 20 (refer to FIG. 5), and a quilt pattern selection screen 21 (refer to FIG. 6), and the like.

The above described touch panel 6A is provided in the front face of the color display 5 and is provided with a plurality of touch keys composed of transparent electrodes in matrix alignment. By pressing the touch keys 6 in the utility pattern selection screen 20 and the quilt pattern selection screen 21, a given sewing pattern is selected from a plurality of sewing patterns displayed on the color display 5. When a sewing pattern is selected in the utility pattern selection screen 20, a switch is made to the first mode. When a sewing pattern is selected in the quilt pattern selection screen 21, a switch is made to the second mode.

The arm 3 is provided with a laterally extending main shaft (not shown) rotationally driven by a sewing machine motor 9 (refer to FIG. 4); a hand pulley 10 for manually rotating the main shaft, a needle-bar drive mechanism (not shown) that vertically moves the needle bar 11 having a sewing needle 4 attached to the lower end thereof; and a needle-bar swing mechanism (not shown) that vertically swings the needle bar 11 in a direction perpendicular to a cloth feed direction; a thread take-up drive mechanism (not shown) that vertically moves a thread take-up (not shown) in synchronization with the vertical movement of the needle bar 11; and a vertical movement mechanism 14 (refer to FIG. 3) that vertically moves the presser bar 13 having a presser foot 12 mounted on the lower end thereof. Various switches such as a start/stop switch 16 for instructing start and stop of a sewing operation is provided in the front side of the arm 3.

Next, a description will be given on the vertical movement mechanism 14.

Figure 3:
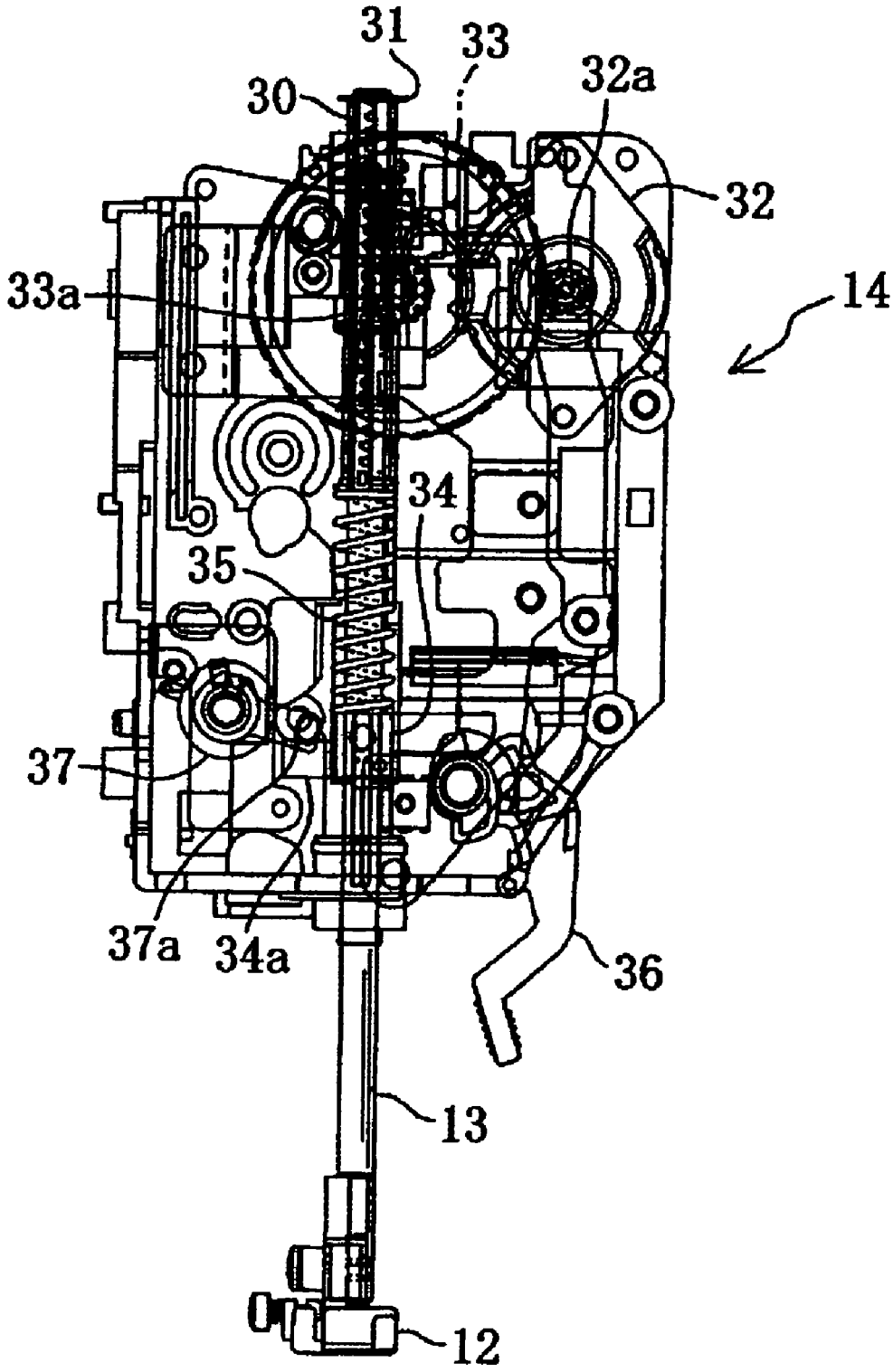
FIG. 3 is a transverse front view of a vertical movement mechanism.

Referring to FIG. 3, the vertical movement mechanism 14 vertically moves a presser bar 13 supported vertically movably with respect to a sewing machine frame disposed in the rear side of the needle bar 11; and a presser foot 12 mounted on the lower end of the presser bar 13. The vertical movement mechanism 14 includes a rack forming element 30; a stop ring 31 secured on the upper end of the presser bar 13; a presser-bar driving step motor 32 for vertically driving the presser bar 13; a drive gear 32*a* connected to an output shaft of the presser-bar driving step motor; an intermediate gear 33 in mesh engagement with the drive gear 32*a*; a presser bar clamp 34 secured on a mid-portion of the presser bar 13; and a presser spring 35 provided on an outer peripheral portion of the presser bar 13 between the rack forming element 30 and the presser bar clamp 34. The rack forming element 30 is provided on the upper-end side of the outer peripheral portion of the presser bar 13 so as to be vertically movable with respect to the presser bar 13. The presser spring 35 connects the rack forming element 30 and the presser bar clamp 34.

The intermediate gear 33 is integrally provided with a small-diameter pinion 33*a*, and the pinion 33*a* is in mesh engagement with the rack of the rack forming element 30. A presser foot lifting lever 36 for vertically moving the presser bar 13 by manual operation is provided in the immediate right side proximity of the presser bar clamp 34. A potentiometer 37 for detecting the height of the presser foot 12 is provided in the immediate left side portion of the presser bar 13.

A lever 37*a* extending rightward from a rotational shaft of the potentiometer 37 is in abutment with the upper surface of a projection 34*a* projecting leftward from the presser bar clamp 34 and is swung in response to the vertical movement of the presser bar 13 and the presser bar clamp 34. The rotational shaft of the potentiometer 37 is rotated by the swinging of the lever 37*a*, whereby the resistance value of the potentiometer 37 is changed. The control unit C (refer to FIG. 4) detects the height of the presser foot 12 based on the resistance value of the potentiometer 37.

When the presser-bar driving step motor 32 is driven by the instructions given by the control unit C, the drive force of the presser-bar driving step motor 32 is transmitted to the intermediate gear 33 and the pinion 33*a* to vertically move the rack forming element 30. Thus, the presser bar 13 is vertically moved via the elastic force exerted by the presser spring 35, thereby allowing the presser foot 12 to vertically move within the range of an uppermost position and a lowermost position.

Next, a description will be given on a control system of the sewing machine M.

Figure 4:
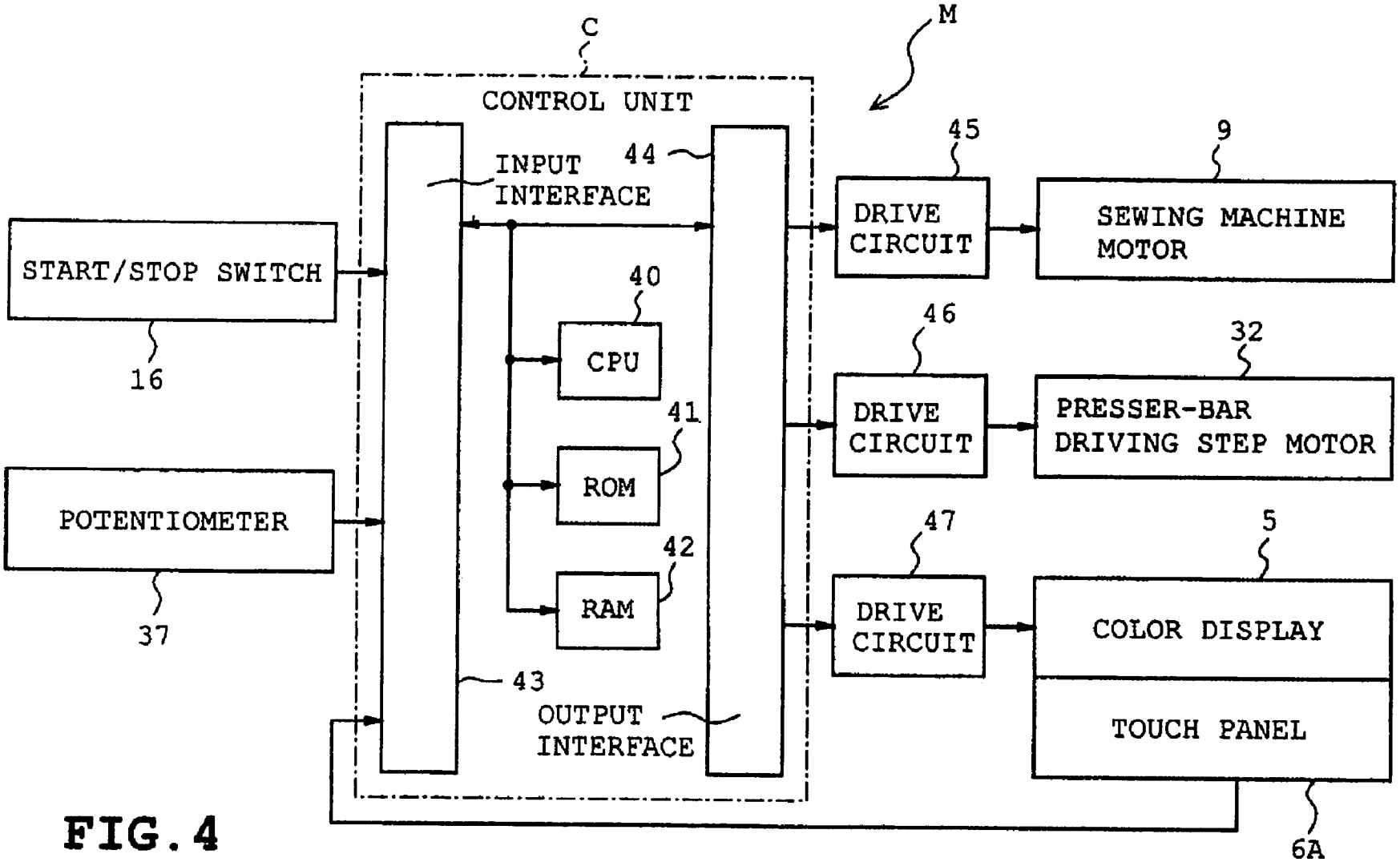
FIG. 4 is a block diagram of a control system of a sewing machine.

Referring to FIG. 4, the control unit C includes a microcomputer including a CPU 40, a ROM 41, and a RAM 42; an input interface 43 and an output interface 44 connected to the microcomputer via data bus, and the like.

The input interface 43 has the start/stop switch 16, the potentiometer 37, and the touch panel 6A connected thereto. The output interface 44 has a sewing machine motor 9, a presser-bar driving step motor 32 and the color display 5 electrically connected thereto via drive circuits 45 to 47 respectively.

The ROM 41 has preinstalled therein a control program for utility sewing; a control program for quilting; a control program for embroidery sewing based on embroidery data; a presser foot vertical movement control program for controlling the presser-bar driving step motor 32 in accordance with the mode; a display control program for displaying various information on the color display 5; and a pattern selection control program for selecting given sewing patterns from a plurality of sewing patterns displayed on the color display 5, and the like.

When the control unit C starts the presser foot vertical movement control program, the presser-bar driving step motor 32 is controlled so as to move the presser foot 12 based on an input signal delivered from the start/stop switch 16. More specifically, when a switch is made to the first mode, the control unit C controls the presser-bar driving step motor 32 so as to lower the presser foot 12 and retain the presser foot 12 in a cloth pressing position to hold the workpiece cloth regardless of the status of the sewing operation. On the other hand, when a switch is made to the second mode, the control unit C retains the presser foot 12 in a slightly lifted position elevated by small distance from the workpiece cloth while the sewing operation is ongoing, whereas when the sewing operation is stopped, the presser-bar driving step motor 32 is controlled to lower the presser foot 12 to the cloth pressing position.

Sewing data memory provided in the ROM 41 has sewing data for a plurality of sewing patterns pre-stored therein. In executing a sewing process with the sewing machine M, sewing data of the selected sewing pattern is read from the sewing data memory and stored in the data memory of the RAM 42. The RAM 42 has the data memory and various work memory provided therein and the data memory stores sewing data read from the sewing data memory of the ROM 41 to be used for sewing.

Figure 7:
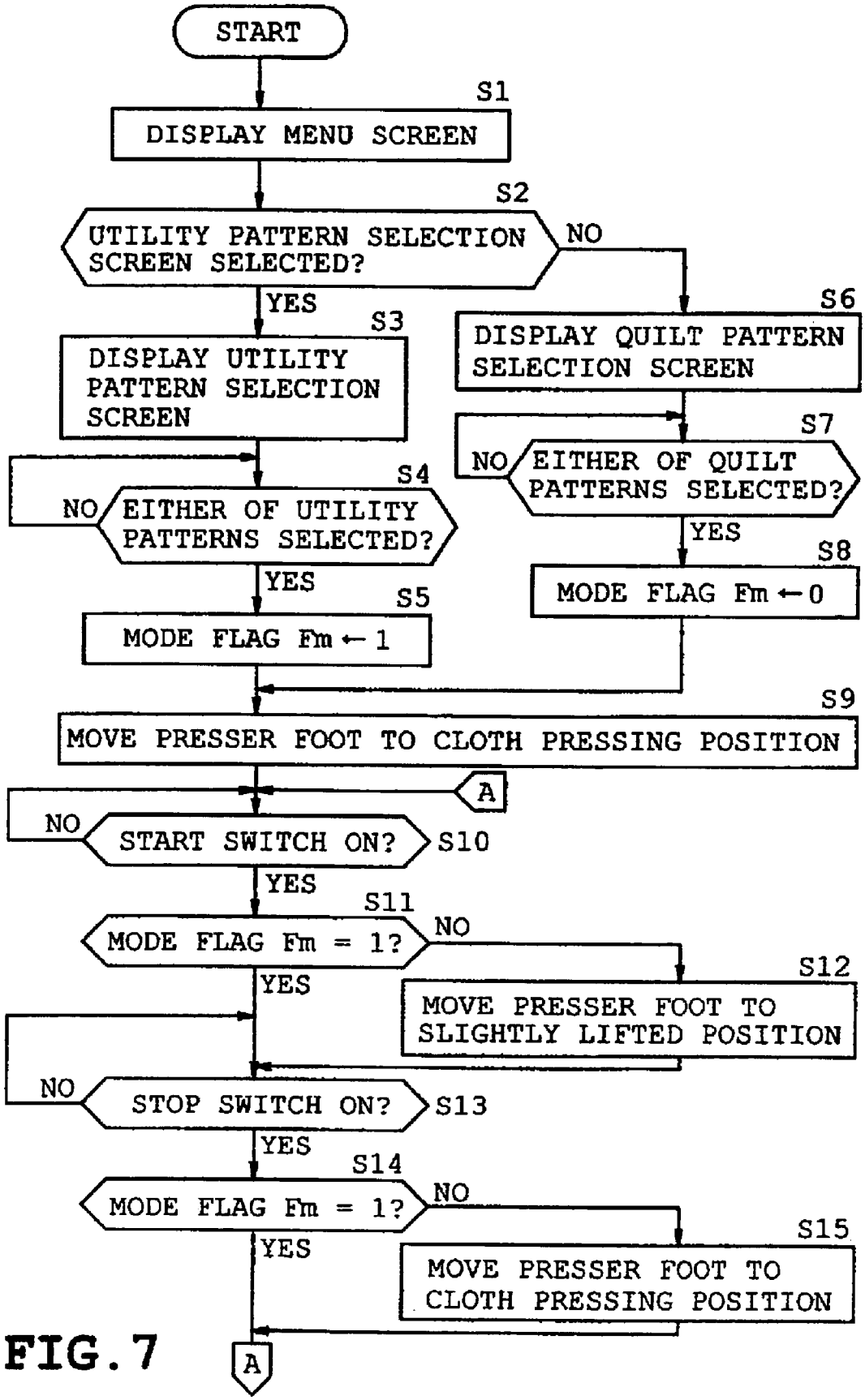
FIG. 7 is a flowchart of a presser foot vertical movement control.

Next, the presser foot vertically moving control executed by the control unit C is described based on the flowchart indicated in FIG. 7. Reference symbol Si (i=1, 2 . . . ) indicate each step number.

When power is supplied to the sewing machine M, the control unit C displays a menu screen on the color display 5 (step S1). The menu screen displays a utility pattern group selection key, a quilt pattern group selection key, and the like. The control unit C proceeds to step S2 and determines whether or not the utility pattern selection screen 20 has been selected or not. In case the utility pattern group selection key displayed on the menu screen has been pressed (step S2: Yes), the control unit C displays the utility pattern selection screen 20 on the color display 5 (step S3).

When the touch key 6 is pressed in the utility pattern selection screen 20, a utility pattern corresponding to the pressed touch key 6 is selected independently among the plurality of utility patterns pre-stored in the ROM 41. When either of the touch keys 6 is pressed and either of the utility patterns is selected (step S4: Yes), the control unit C sets "1" to the mode flag Fm stored in the RAM 42 (step S55) and makes a switch to the first mode. The first mode is set in the initial setting.

On the other hand, in the above step S2, when the quilt pattern group selection key displayed on the menu screen is pressed and the quilt pattern selection screen 21 is selected (step S2: No), the control unit C displays the quilt pattern selection screen 21 on the color display 5 (step S6). When the touch key 6 is pressed in the quilt pattern selection screen 21, the quilt pattern corresponding to the pressed touch key 6 is selected independently among a plurality of quilt patterns pre-stored in the sewing data memory of the ROM 41. When either of the touch keys 6 is pressed and either of the quilt patterns is selected (step S7: Yes), the control unit C sets the mode flag Fm stored in the RAM 42 to "0" (step S8) and makes a switch to the second mode.

When mode flag Fm setting is completed, the control unit C drives the presser-bar driving step motor 32 and lowers the presser foot 12 along with the presser bar 13 to place the presser foot 12 in the cloth pressing position to press the workpiece cloth (step S9). Next, when the start/stop switch 16 is turned on (step S10: Yes), the control unit C starts the sewing operation and determines whether or not the mode flag Fm stored in the RAM 42 is "1" or not (step S11). In case the mode flag Fm is "1" (step S11: Yes) in other words, in case a switch has been made to the first mode, the control unit C controls the presser-bar drive step motor 32 so as to retain the presser foot 12 in the cloth pressing position.

On the other hand, in case the mode flag FM is "0" (step S11: No), that is, in case a switch has been made to the second mode, the control unit C drives the presser-bar driving step motor 32 and lifts the presser foot 12 along with the presser bar 13. While the presser foot 12 is being lifted, the control unit C detects the height of the presser foot 12 based on the resistance value of the potentiometer 37. When the presser foot 12 is lifted to the slightly lifted position elevated from the workpiece cloth by a predetermined small distance (1 mm, for example) (step S12), the control unit C controls the presser-bar driving step motor 32 so as to retain the presser foot 12 in the slightly lifted position.

When the start/stop switch 16 is turned on again, (step S13: Yes), the control unit C stops the sewing operation and determines whether or not the mode flag Fm stored in the RAM 42 is "1" or not (step S14). In case the mode flag Fm is "1", (step S14: Yes), in other words, in case the first mode is set, the control unit C controls the presser-bar drive step motor 32 so that the presser foot 12 is retained in the cloth pressing position, and thereafter repeats steps S10 onwards.

On the other hand, in case the mode flag Fm is "0" (step S14: No), in other words, in case a switch is made to the second mode, the control unit C drives the presser-bar drive step motor 32 and lowers the presser foot 12 along with the presser bar 13 to the cloth pressing position (step S15). Then, the presser-bar drive step motor 32 is controlled so as to retain the presser foot 12 in the cloth pressing position. In case the second mode is set, the control unit C returns to step S10 as well, and when the start/stop switch 16 is turned on (step S10: Yes), the sewing operation is restarted. Then, the presser-bar driving step motor 32 is controlled so as to lift the presser foot 12 from the cloth pressing position to the slightly lifted position (step S12).

Next, a description will be given on the operation of the sewing machine M having the above described configuration.

In case of executing free motion quilting, when either of the quilt patterns is selected by pressing the touch key 6 in the quilt pattern selection screen 21, a switch is automatically made to the second mode.

When the sewing operation is started, the presser foot 12 is moved to the slightly lifted position and is retained in the slightly lifted position while the sewing operation is ongoing. When the sewing operation is stopped during the sewing process, the presser foot 12 is lowered to the cloth pressing position and retained in the cloth pressing position while the sewing operation is stopped. Thus, the workpiece cloth is less prone to be displaced even if the user contacts the workpiece cloth while sewing operation is stopped or even if the workpiece cloth is affected by its own weight. Thus, no displacement takes place in the sewing position of the workpiece cloth, that is, the positions of the stitches being formed when restarting the sewing operation.

As described above, according to the present embodiment, when a switch is made to the first mode, normal sewing such as utility pattern sewing can be executed since the presser foot 12 is retained in the cloth pressing position to press the workpiece cloth irrespective of the operational status of the sewing process.

On the other hand, when a switch is made to the second mode, since the presser foot 12 is retained in the slightly lifted position elevated from the workpiece cloth by a predetermined distance while the sewing operation is ongoing, the user is allowed to manually feed the workpiece cloth, thus being suitable for free motion quilting. In the second mode, since the presser foot 12 is moved to the cloth pressing position when the sewing operation is stopped, the workpiece cloth is not displaced even when the user contacts the workpiece cloth while the sewing operation is stopped or when the workpiece cloth is affected by its own weight. Thus, displacement of the workpiece cloth in restarting the sewing operation can be prevented.

Further, when the sewing operation is stopped, since the presser foot 12 is automatically moved to the position to press the workpiece cloth, the user is not required to manually lower the presser foot 12 every time the sewing operation is stopped, and thus, there is no reduction in work efficiency. Since mode switching is executed in synchronization with the selection of sewing pattern by pressing the touch key 6, by selecting the desired sewing pattern in the touch panel 6A, automatic switching can be made between the utility sewing mode and the free motion quilting mode. Thus, mode switching can be carried out by simple operation.

Further, when the sewing operation is restarted from a state in which the sewing operation is stopped in the second mode, the presser foot 12 is moved from the cloth pressing position to the slightly lifted position. Thus, the user is not required to lift the presser foot 12 by manually operating the presser foot lifting lever 36, thereby improving work efficiency.

Further, a start/stop switch 16 to start and stop the sewing operation has been provided, and the presser foot 12 is moved by the input signal delivered from the start/stop switch 16. Thus, when quilting in free motion, the presser foot 12 can be readily moved by operating the start/stop switch 16.

Next, partial modifications of the above described embodiment will be described hereinafter.

Figure 8:
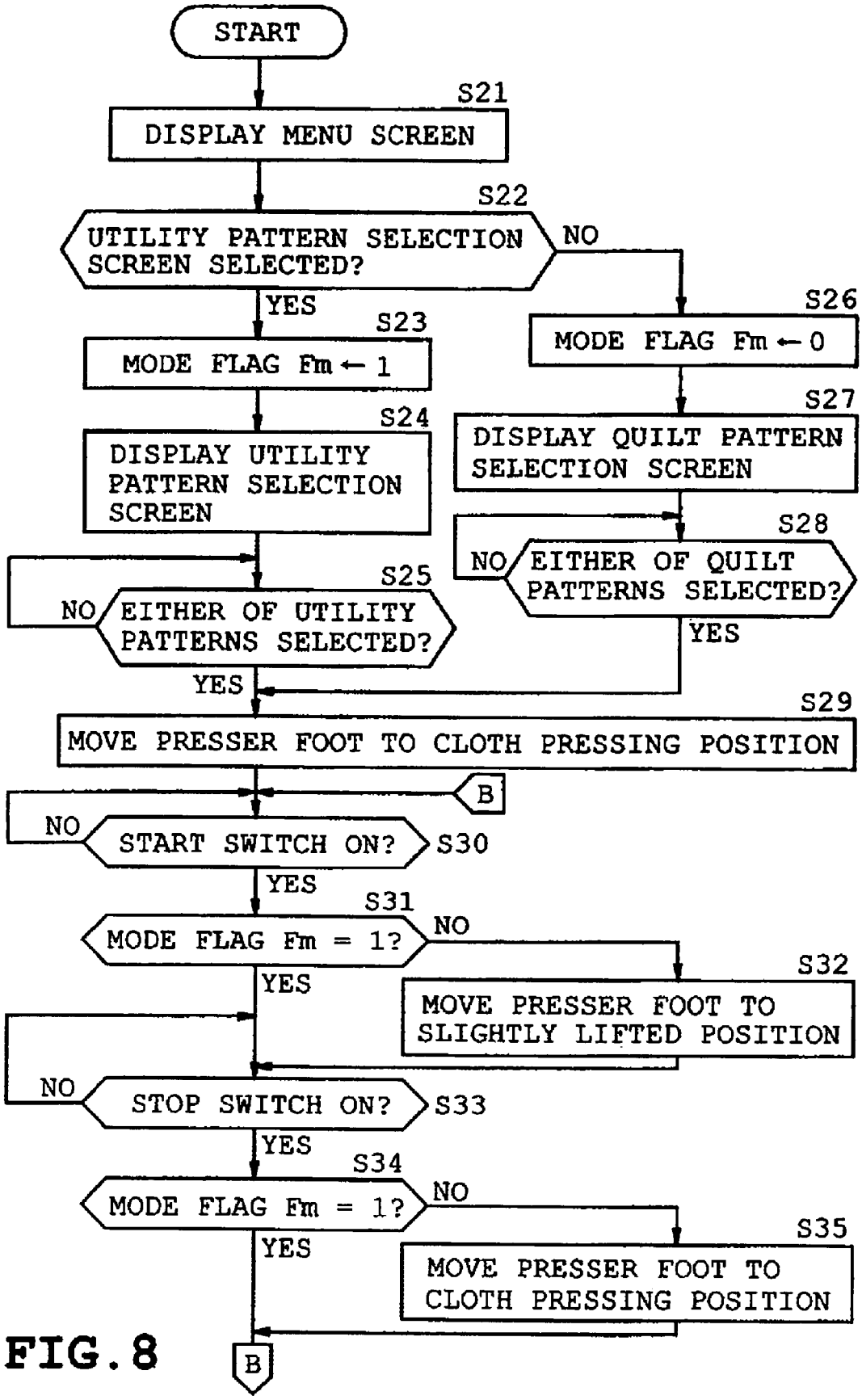
FIG. 8 is flowchart of the presser foot vertical movement control indicating a modified embodiment of the present disclosure.

Mode switching may be executed when a sewing pattern group has been selected in the menu screen. To describe more specifically by referring to FIG. 8, when power is supplied to the sewing machine M, the control unit C displays the menu screen on the color display 5 (step S21). When the utility pattern selection screen 20 is selected in the menu screen (step S22: Yes), the control unit C sets the mode flag Fm stored in the RAM 42 to "1" (step S23), and makes a switch to the first mode. Then, the utility pattern selection screen 20 is displayed to the color display 5 (step S24).

On the other hand, in case the quilt pattern selection screen 21 is selected in the menu screen (step S22: No), the control unit C sets "0" to the mode flag Fm (step 26), and makes the switch to the second mode. Then, the quilt pattern selection screen 21 is displayed on the color display 5 (step S27). Steps S29 to S35 following thereafter are the same as steps S9 to S15 of the flowchart indicated in FIG. 7, thus, no explanation will be given for the same.

The present disclosure is not limited to the above described embodiment and its modifications but may be modified or expanded as follows.

A mode switching switch may be provided on the front side of the arm 3 and mode switching may be executed by manual operation of the mode switching switch instead of switching the mode based on pressing of the touch key 6.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

a vertical movement actuator that vertically drives a presser bar having a presser foot attached thereto;

a control unit that controls the vertical movement actuator to selectively execute a first mode or a second mode;

a mode switch unit capable of selectively switching between the first mode and the second mode; and the control unit, when switched to the first mode, controls the vertical movement actuator so as to lower the presser foot and retain the presser foot at a cloth pressing position in which a workpiece cloth is pressed irrespective of an operational status of a sewing process; and when switched to the second mode, controls the vertical movement actuator so as to retain the presser foot in a slightly lifted position that is elevated from the workpiece cloth by a predetermined small distance while a sewing operation is ongoing, whereas when the sewing operation is stopped, the presser foot is moved and retained in the cloth pressing position.

2. The sewing machine of claim 1, wherein the mode switch unit functions as a pattern selection unit that selects a sewing pattern or a sewing pattern group, and the first mode is set as a utility sewing mode that sews utility patterns and the second mode is set as a free motion quilting mode that executes quilting in free motion.

3. The sewing machine of claim 2, further comprising an operation input unit that starts and stops the sewing operation, wherein the control unit controls the vertical movement actuator to move the presser foot based on an input signal from the operation input unit.

4. The sewing machine of claim 2, wherein the control unit, when switched to the second mode, controls the vertical movement actuator so as to move the presser foot from the cloth pressing position to the slightly lifted position when the sewing operation is restarted from sewing operation stopped state.

5. The sewing machine of claim 4, further comprising an operation input unit that starts and stops the sewing operation, wherein the control unit controls the vertical movement actuator to move the presser foot based on an input signal from the operation input unit.

6. The sewing machine of claim 1, wherein the control unit, when switched to the second mode, controls the vertical movement actuator so as to move the presser foot from the cloth pressing position to the slightly lifted position when the sewing operation is restarted from sewing operation stopped state.

7. The sewing machine of claim 6, further comprising an operation input unit that starts and stops the sewing operation, wherein the control unit controls the vertical movement actuator to move the presser foot based on an input signal from the operation input unit.

8. The sewing machine of claim 1, further comprising an operation input unit that starts and stops the sewing operation, wherein the control unit controls the vertical movement actuator to move the presser foot based on an input signal from the operation input unit.

* * * * *